US005594976A

United States Patent [19]

Shkolnik et al.

[11] Patent Number: 5,594,976

[45] Date of Patent: Jan. 21, 1997

[54] PIVOT ASSEMBLY

[75] Inventors: Nikolay Shkolnik; Baruch Kantor, both of West Hartford, Conn.; Domingos Joaquim, Springfield, Mass.

[73] Assignee: Hasbro, Inc., Pawtucket, R.I.

[21] Appl. No.: 327,722

[22] Filed: Oct. 24, 1994

[51] Int. Cl.[6] ..... E05D 5/12; E05D 7/10

[52] U.S. Cl. ..... 16/380; 16/260; 16/266; 16/254; 16/382

[58] Field of Search ..... 16/380, 260, 261, 16/266, 382, 262, 254, 271

[56] References Cited

U.S. PATENT DOCUMENTS 1,615,924 2/1927 Yancey .
2,449,116 9/1948 Hatchett .
3,425,153 2/1969 Bonanno et al. .
3,495,348 2/1970 Mitchell .
3,908,303 9/1975 McKay et al. .
4,149,725 4/1979 Todokoro .
4,603,860 8/1986 Wey .
5,193,819 3/1993 Chen .

*Primary Examiner*—M. Rachuba
*Assistant Examiner*—Adesh Bhargava
*Attorney, Agent, or Firm*—Kurt R. Benson

[57] ABSTRACT

A pivot assembly for mounting a pivot arm on a housing includes in a first embodiment thereof a pair of spaced mounting walls which extend inwardly in the housing adjacent opposite side extremities of a pivot opening therein and a pivot shaft on the pivot arm. The mounting walls have open notches therein which open outwardly through the pivot opening for receiving the pivot shaft therein, and the mounting walls and the pivot arm have retaining members thereon which cooperate to retain the pivot shaft in the notches. In a second embodiment the pivot assembly includes a concave mounting seat, a pivot arm having a pivot shaft which is received in mating engagement in the mounting seat and a retaining member having a convex retaining face thereon which is received in mating engagement with a corresponding concave pivot face on the pivot member for retaining the pivot shaft in the mounting seat.

19 Claims, 6 Drawing Sheets

PIVOT ASSEMBLY

BACKGROUND AND SUMMARY OF THE INVENTION

The instant invention relates to mounting structures for mounting pivotable members on base structures, including housings, and more particularly to a pivot assembly comprising a pivot arm and a mounting assembly which is adapted to enable the pivot arm to be more easily and efficiently assembled therewith for pivotably mounting it on a base member, such as a housing.

Heretofore, the most common technique for pivotably mounting a pivot arm on a housing so that the requisite mounting structure is concealed within the housing has been to mount the pivot arm on a pair of spaced, substantially parallel mounting walls which extend inwardly in the housing adjacent opposite side extremities of an opening therein. More specifically, the most common heretofore known mounting technique has been to assemble a pivot shaft on the pivot arm in aligned apertures in the mounting walls so that the shaft is permanently captured in rotatable relation in the apertures and so that the pivot arm extends outwardly through the opening in the housing. However, in order to mount a pivot arm in this manner, the mounting walls must be resiliently separated in order to assemble the pivot shaft in the apertures therein. Since the mounting walls of a structure of this type normally extend inwardly from the housing wall, they generally cannot be separated except at their innermost terminal end portions. Accordingly, heretofore it has generally been necessary to assemble a pivot arm in a mounting structure of this type by passing the pivot arm outwardly through an opening in the housing and then separating the inner end portions of the mounting walls in the interior of the housing as the shaft on the pivot arm is moved upwardly therebetween.

As an alternative to the above, another type of prior art mounting assembly includes a pair of U-shaped mounting walls which depend from the inner side of a housing wall adjacent opposite sides of a pivot opening therein. This type of mounting assembly also includes a pair of converging resilient retainer tabs which depend from the inner side of the housing wall so that each tab extends between the legs of a U-shaped mounting wall for retaining a pivot shaft attached to a pivot member in engagement in the U-shaped mounting walls. However, it has been found that the retainer tabs of this type of structure are necessarily relatively short so that they generally lack sufficient resilience to receive a pivot shaft therebetween and are, as a result, prone to breakage.

The instant invention provides an effective mounting structure for mounting a pivot member on a base member, such as a housing or another base structure, and, in its broadest form, the instant invention comprises a base member including a mounting portion and a pivot member also including a mounting portion. The mounting portion of the base member includes oppositely facing arcuate, concentric, radially spaced, concave pivot and convex retaining faces thereon, and the mounting portion of the pivot member includes oppositely facing, arcuate, concentric, radially spaced, convex pivot and concave retaining faces thereon which are received in mating engagement with the concave pivot and convex retaining faces on the base member. Accordingly, the retaining faces on the base member and the pivot member cooperate to retain the pivot faces on the base member and the pivot member in mating engagement so that the pivot member is pivotable about a predetermined pivot axis. The pivot faces and the retaining faces of the pivot member and the base member are preferably disposed within a common 180 degree sector about the pivot axis, and the base member preferably comprises a housing having a pivot opening therein. The base member preferably extends inwardly in the housing adjacent the pivot opening, and accordingly the mounting portion of the pivot member is also located in the housing. Further, the pivot member preferably includes a pivot arm which extends outwardly through the pivot opening.

Accordingly, the instant invention also provides an effective mounting structure which enables a pivot arm to be assembled with a housing by passing the pivot arm inwardly rather than outwardly through a pivot opening in the housing. More specifically, a first embodiment of the instant invention provides a pivot assembly comprising a pivot arm having a pivot shaft thereon and a mounting structure comprising a pair of mounting walls having notches therein which open outwardly through the pivot opening so that the pivot shaft can be assembled in the notches by passing the shaft and the adjacent portions of the pivot arm inwardly through the pivot opening. Still more specifically, the first embodiment of the pivot assembly of the instant invention comprises a housing including an outer wall having a pivot opening therein, and a pair of spaced substantially parallel mounting walls extending inwardly in the housing adjacent spaced opposite side extremities of the pivot opening. The mounting walls have substantially parallel notches therein which define a pivot seat in the housing and which open outwardly through the pivot opening, and the assembly further comprises a pivot arm including an elongated arm portion and a substantially transversely extending pivot shaft portion having a pivot axis. The pivot shaft portion is received in the notches in the mounting walls for pivotably mounting the pivot arm on the housing. In this embodiment the assembly further includes a first retaining member in the housing which is preferably located on one of the spaced mounting walls and a second retaining member on the pivot member in outwardly spaced relation to the shaft portion thereof. The first retaining member on the mounting walls and the second retaining member on the pivot member are positioned so that the second retaining member is disposed further inwardly in the housing relative to the first retaining member, and so that the second retaining member rides on the first retaining member as the pivot member is pivoted in the pivot opening. Further, in the first embodiment the retaining members are preferably constructed and oriented so that when the pivot member is pivoted to an extreme position, the second retaining member is disengaged from the first retaining member to permit the pivot shaft to be removed from the notches in the mounting walls by passing it outwardly through the pivot opening. In this embodiment, the pivot assembly preferably includes a first retaining member on each of the mounting walls, and the first retaining members preferably extend inwardly and together terminating in spaced relation. The first retaining members are preferably formed as arcuate ridges on the mounting walls which are coaxially oriented relative to the pivot axis, and the second retaining member preferably comprises an arcuate guide wall segment which is coaxially oriented relative to the pivot axis and rides on the ridges on the mounting walls as the pivot member is pivoted.

It has been found that the pivot assembly of the first embodiment of the instant invention has specific advantages over the heretofore available pivot assemblies. Specifically, because the pivot shaft on the pivot member is received in outwardly opening notches in a pair of mounting walls, the entire pivot member can be assembled with the mounting walls by inserting the requisite portions of the pivot member, including the pivot shaft, inwardly through the pivot opening so that the shaft is received in the notches, and by then pivoting the pivot member to a position in which the retaining members cooperate to retain the pivot shaft in rotatable engagement in the notches. Accordingly, the first embodiment of the pivot assembly is adapted to permit the pivot member to be efficiently and easily assembled with the housing so that the pivot member is effectively pivotably retained in the housing, but so that it is nevertheless removable therefrom.

In a second embodiment of the instant invention, the pivot assembly comprises a base member having a base member mounting portion thereon and a pivot member having a pivot member mounting portion thereon which is received in engagement with the base member mounting portion. In this embodiment the base member mounting portion includes a mounting seat having an arcuate concave pivot face thereon and a pair of retaining elements on opposite sides of the mounting seat. The retaining elements have arcuate convex retaining faces thereon which are concentric with the pivot face of the mounting seat but which are radially spaced therefrom and face in the opposite direction. The pivot member mounting portion includes an arcuate pivot element having an arcuate convex pivot face on one side thereof which is received in mating engagement with the pivot face on the mounting seat. In this embodiment, the pivot element preferably also includes an arcuate concave retaining face on the opposite side thereof which is received in mating engagement with the retaining faces of the retaining elements for retaining the pivot element in the pivot seat.

It has been found that the second embodiment of the pivot assembly of the instant invention also represents a significant improvement over the previously known pivotal mounting structures. Specifically, it provides an easy to assemble mounting structure which provides sufficient clearance to enable a pivot member to be freely pivoted without interference from the mounting structure.

Accordingly, it is a primary object of the instant invention to provide an effective pivot assembly comprising a housing and a pivot member wherein the pivot member can be effectively pivotably assembled with a mounting structure in the housing by passing a pivot shaft on the pivot member inwardly through a pivot opening in the housing.

Another object of the instant invention is to provide a pivot assembly comprising a housing and a pivot member wherein the pivot member is adapted to be quickly and efficiently assembled in a pivot structure in the housing.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
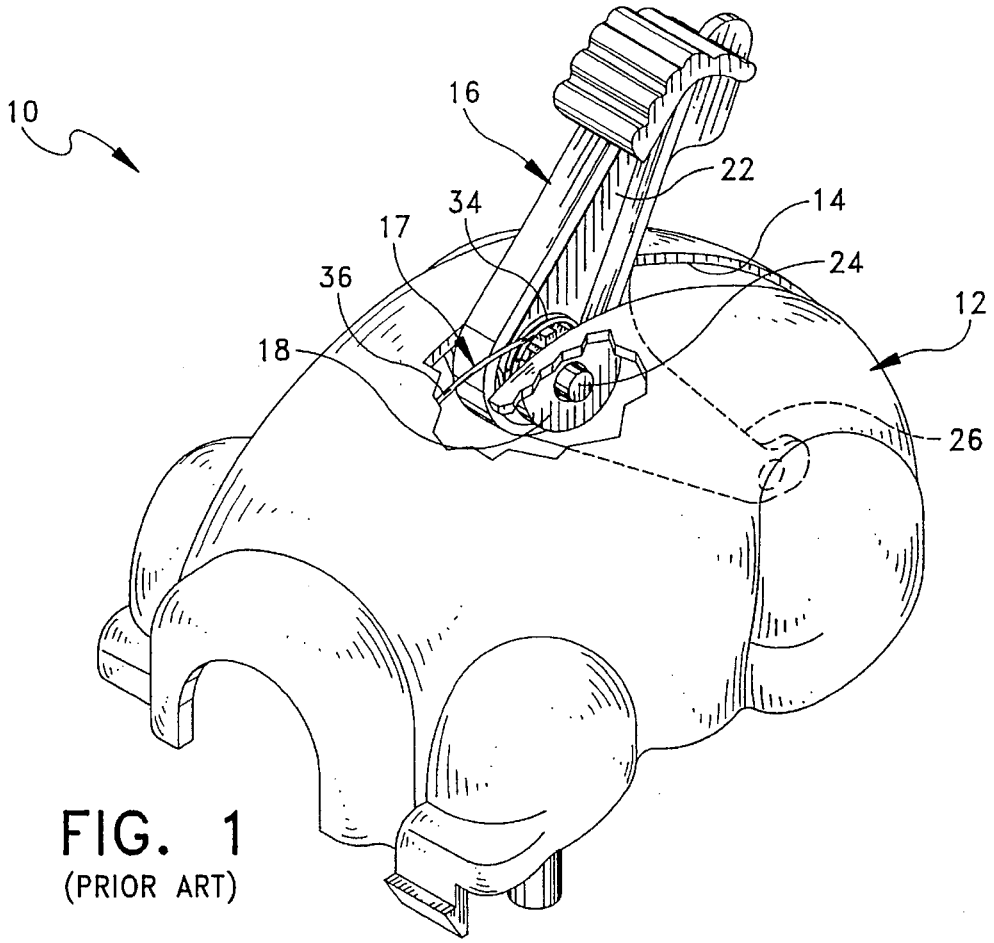
FIG. 1 (PRIOR ART)
FIG. 1 is a perspective view of a pivot assembly of the prior art with portions of the housing thereof broken away.
Figure 2:
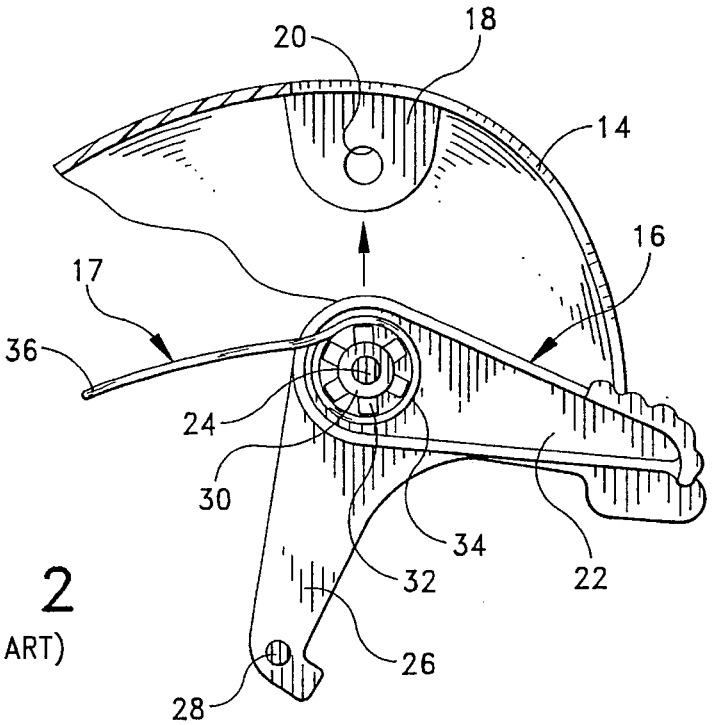
FIG. 2 (PRIOR ART)
FIG. 2 is an exploded fragmentary sectional view thereof.

Referring now to the drawings, a pivot assembly of the prior art is illustrated in FIGS. 1 and 2 and generally indicated at 10. The pivot assembly 10 comprises a housing generally indicated at 12 having an elongated pivot slot or opening 14 therein, a pivot member generally indicated at 16, and a torsion spring 17. The housing 12 has a pair of spaced substantially parallel mounting walls 18 formed therein which extend inwardly in the housing 12 adjacent opposite side extremities of the pivot opening 14. The pivot member 16 comprises a main or pivot arm portion 22, a pivot shaft 24, and a lever arm portion 26 having a pivot post 28 thereon. The pivot arm portion 22 is of generally elongated configuration and the pivot shaft 24 extends substantially transversely outwardly from opposite sides of the arm portion 22. Also included in the pivot member 16 is a hub portion 30 at the base of the shaft 24 and a plurality of spacer elements 32 which radiate outwardly around the hub portion 30.

The torsion spring 17 comprises a circular coil portion 34 having a terminal end portion (not shown) which is received in an aperture in the arm portion 22 for nonrotatably securing the torsion spring 17 in position around the spacer elements 32. The torsion spring 17 further comprises an elongated arm portion 36 which extends outwardly from the circular coil portion 34 as illustrated most dearly in FIG. 2.

As will be seen, the various components of the pivot assembly 10 are adapted to be assembled so that the pivot shaft portions 24 are received in the apertures 20 in the mounting walls 18 and so that the main portion 22 of the pivot member 16 extends outwardly through the pivot opening 14. As a result, when the main portion 22 is pivoted on the housing 12, the lever arm portion 26 is correspondingly pivoted in the interior thereof. Further, when the pivot member 16 is assembled in the housing 12 in this manner, the elongated arm portion 36 of the torsion spring 17 biases the pivot member 16 to the forwardly pivoted position illustrated in FIG. 1.

However, while the pivot assembly 10 represents an effective mechanism for pivotably mounting the pivot member 16 on the housing 12, it should be noted that in order for the pivot shaft portions 24 to be assembled in the aperture 20, the mounting walls 18 must be resiliently separated slightly to allow the shaft portions 24 to be received therebetween. Since the mounting walls 18 are integrally formed on the interior of the housing 12 so that they extend downwardly therefrom, it is effectively impossible to resiliently separate the upper portions of the mounting walls 18 to accommodate the shafts 24. Hence, the pivot shafts 24 can actually only be assembled with the mounting walls 18 by passing the shafts 24 upwardly between the free terminal ends of the mounting walls 18 until they are received in the apertures 20. This is because only the terminal end portions of the mounting walls 18 can be deflected sufficiently to accommodate the shafts 24 without rupturing the walls 18. Hence, the pivot assembly 10 can only be assembled by a relatively complex assembly maneuver in which the walls 18 are separated in the interior of the housing 12 and the pivot shafts 24 are passed upwardly therebetween until they are received in the apertures 20.

Figure 2A:
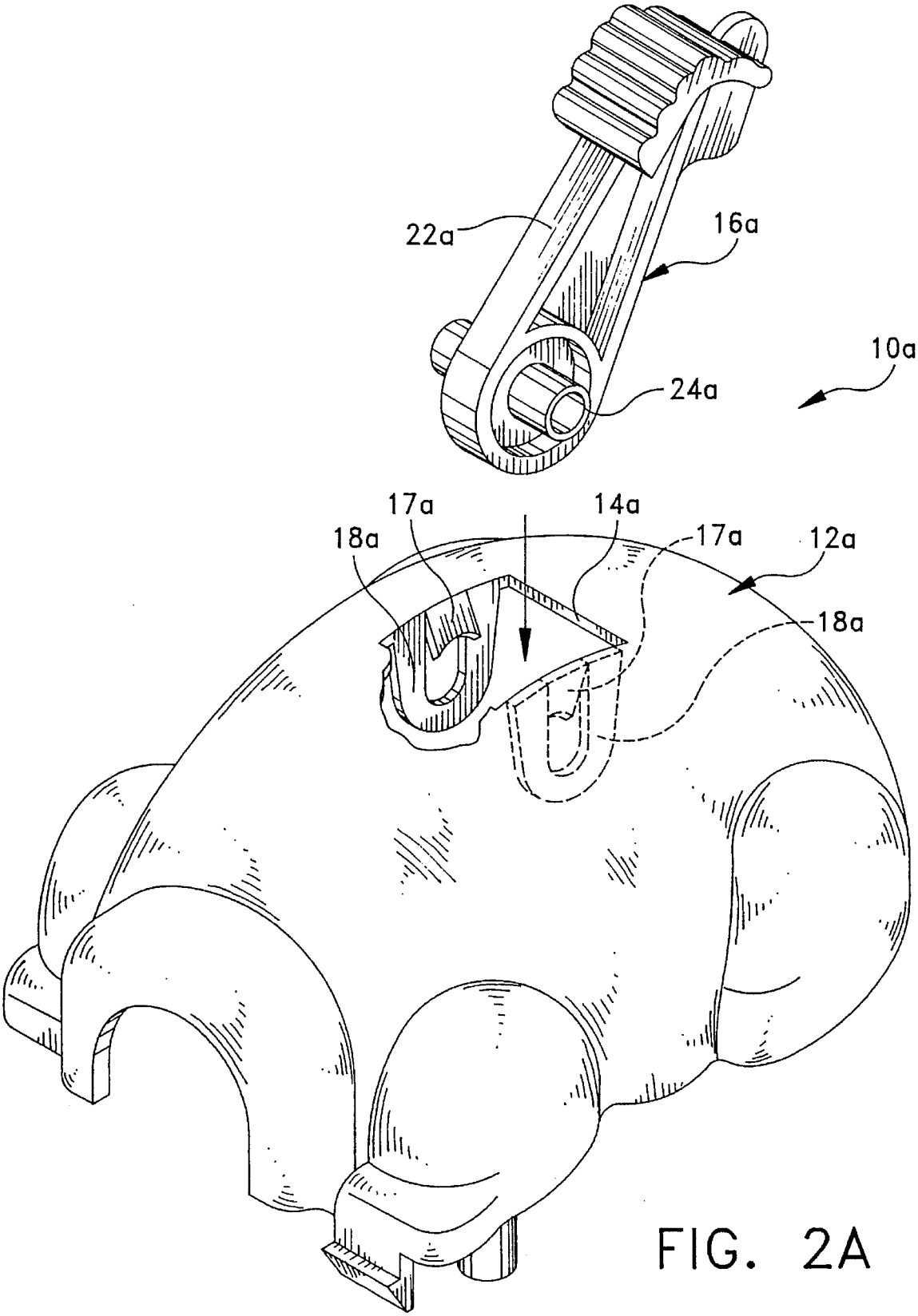
FIG. 2A is an exploded perspective view of another pivot assembly of the prior art with portions of the housing thereof broken away.
Figure 3:
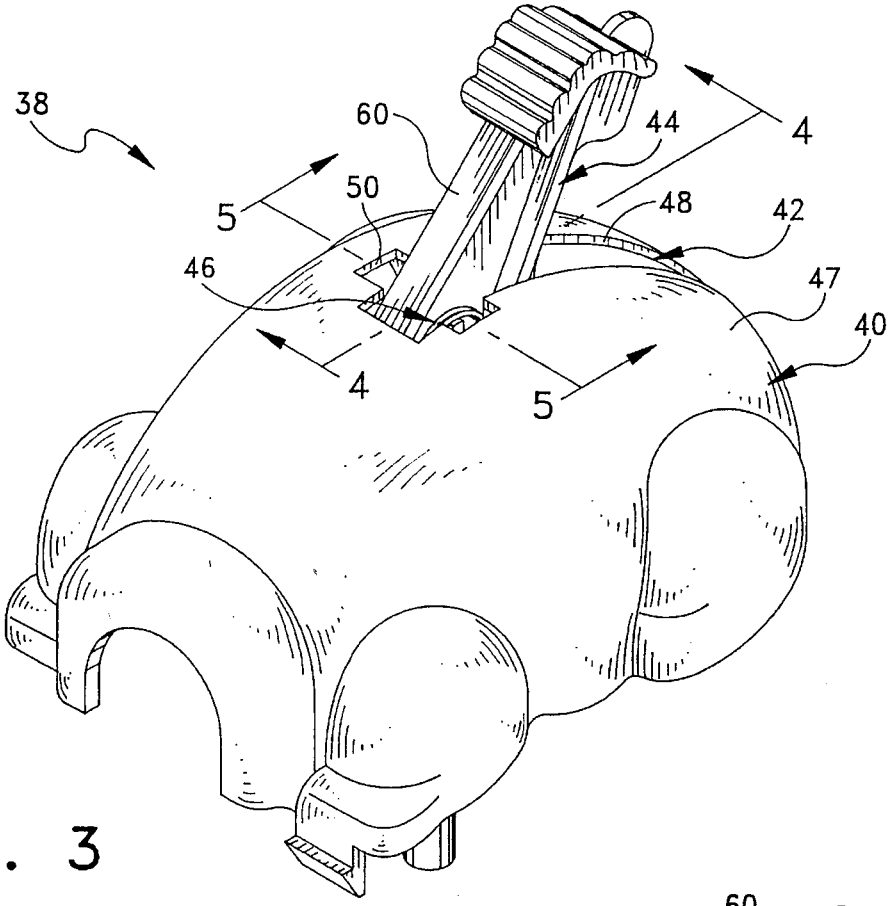
FIG. 3 is a perspective view of the pivot assembly of the instant invention.
Figure 4:
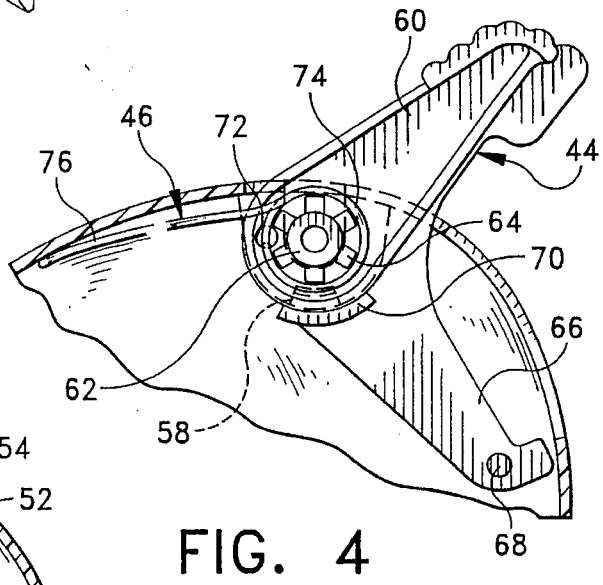
FIG. 4 is a sectional view taken along line 4—4 in FIG. 3.
Figure 5:
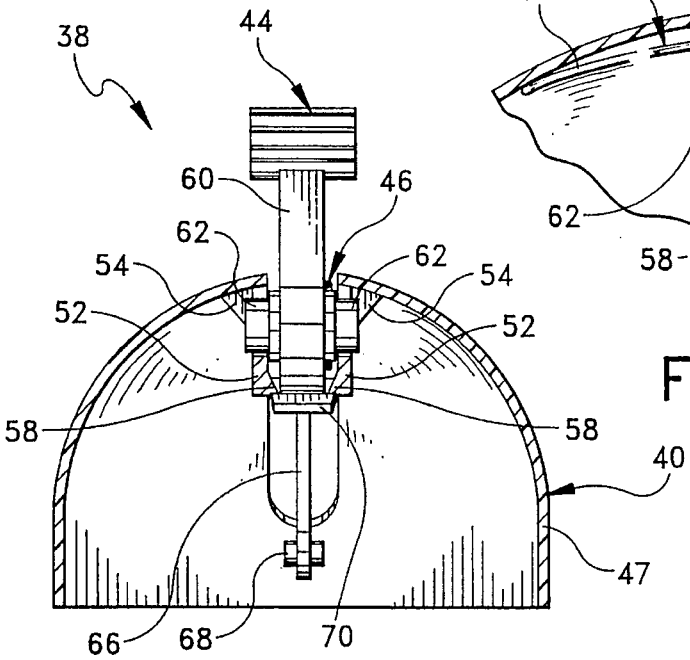
FIG. 5 is a sectional view taken along line 5—5 in FIG. 3.
Figure 6:
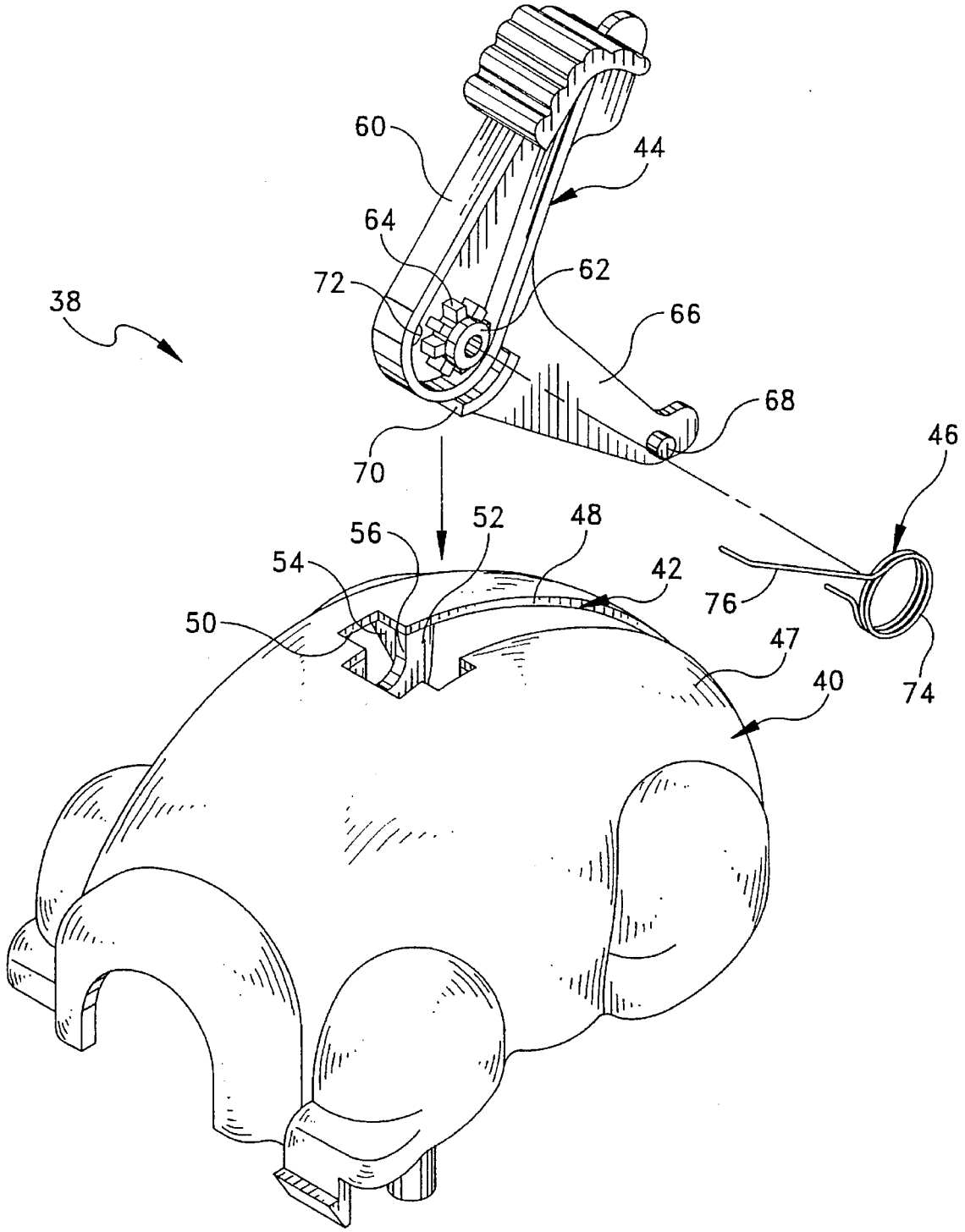
FIG. 6 is an exploded perspective view of the pivot assembly.
Figure 7:
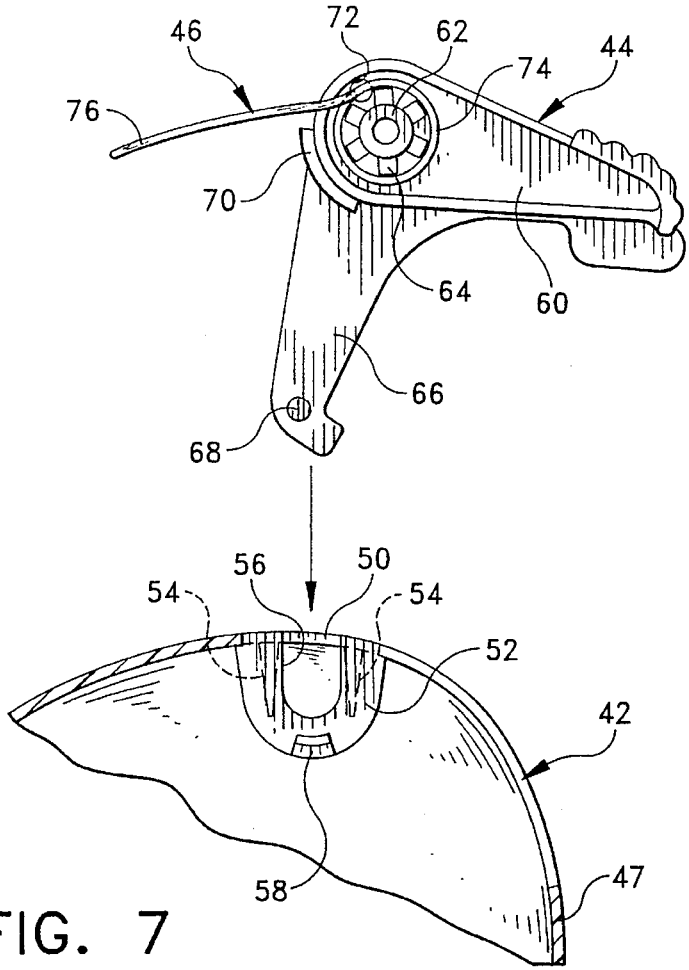
FIG. 7 is an exploded fragmentary sectional view thereof.
Figure 8:
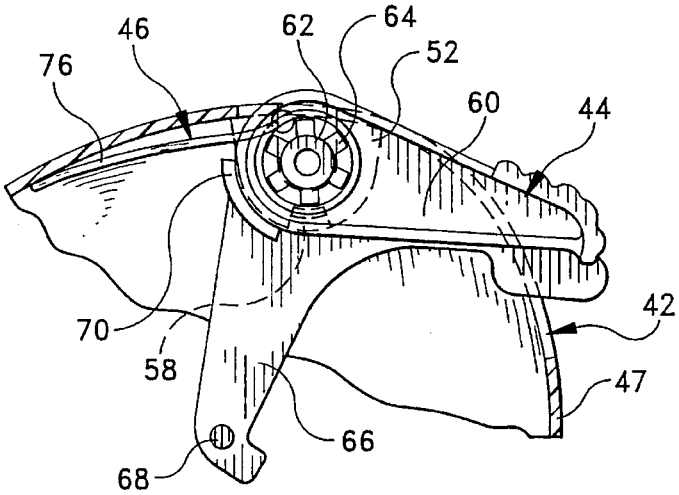
FIG. 8 is a fragmentary sectional view thereof with the pivot arm assembled in the housing.

Referring to FIG. 2A, a second prior art pivot assembly is illustrated and generally indicated at 10*a*. The assembly 10*a* comprises a housing generally indicated at 12*a* having an elongated pivot slot or opening 14*a* therein and a pivot member generally indicated at 16*a*. The housing 12*a* has a pair of spaced substantially parallel U-shaped mounting walls 18*a* formed therein which depend from the inner side of the housing 12*a* adjacent opposite sides of the pivot opening 14*a*. A pair of converging mounting tabs 17*a* are formed in the interior of the housing 12*a* so that they depend from the inner side thereof and extend between the opposite legs of the U-shaped mounting walls 18*a*. The pivot member 16*a* comprises a main or pivot arm portion 22*a* and a pivot shaft 24*a*.

The various components of the pivot assembly 10*a* are adapted to be assembled by passing the shaft 24*a* and the adjacent portions of the pivot arm 16*a* downwardly through the pivot opening 14*a* so that the retainer tabs 17*a* are resiliently separated for receiving the pivot shaft 24*a* in the U-shaped mounting walls 18*a*. As illustrated, once the shaft 24*a* passes by the retainer tabs 17*a* so that it is received in the U-shaped retaining walls 18*a*, the tabs 17*a* cooperate to retain the shaft in rotatable engagement in the U-shaped mounting walls 18*a*. Unfortunately, however, because the retaining tabs 17*a* extend inwardly only a relatively short distance from the housing 12*a*, their resiliency is somewhat limited and they are relatively fragile. Accordingly, while in some instances the assembly 10*a* provides an effective pivot mounting assembly, the inherently fragile construction of the mounting tabs 17*a* has been found to render the assembly 10*a* impractical for many applications.

Referring now to FIGS. 3 through 8, a first embodiment of the pivot assembly of the instant invention is illustrated and generally indicated at 38. The pivot assembly 38 comprises a housing generally indicated at 40 having a pivot slot or opening 42 therein, a pivot member generally indicated at 44, and a torsion spring generally indicated at 46. The pivot assembly 38 is operative in a manner similar to the pivot assembly 10, although it is specifically adapted to permit the pivot member 44 to be assembled with the housing 40 by passing portions of the pivot member 44 downwardly through the pivot opening 42 rather than requiring assembly from the interior of the housing 40 as was the case with the pivot assembly 10.

The housing 40, as herein embodied, comprises a generally open shell or main portion 47 such as might be associated with the body of a character figure in an action board game assembly. The pivot opening 42 includes an elongated main portion 48 and a pair of side portions 50 which extend outwardly from opposite sides of the main portion 48 adjacent the forward end thereof. As illustrated most clearly in FIGS. 5, 6 and 7, a pair of spaced mounting walls 52 having reinforcement gussets 54 thereon are formed in the interior of the main portion 47. The mounting walls 52 are of generally U-shaped configuration, and they have open notches 56 formed therein which open outwardly through the side portions 50 of the pivot opening 42. Integrally formed with the mounting walls 52 are arcuate ridges 58. The ridges 58 are formed on the opposed inwardly facing sides of the walls 52 in downwardly and inwardly spaced relation to the notches 56 as illustrated.

The pivot member 44 is generally similar to the pivot member 16, and it includes a pivot arm portion 60, a pair of hollow shaft portions 62, a plurality of spacer elements 64 which extend outwardly around the shaft portion 62, and a lever arm portion 66 having a connecting post 68 thereon. The pivot member 44 further comprises an arcuate retaining wall segment 70 which is spaced outwardly from the shafts 62 but substantially concentrically configured and oriented relative thereto. The pivot member 44 further includes a reduced aperture 72 which is positioned along the perimeter defined by the spacer element 64.

The torsion spring 46 is essentially identical to the torsion spring 17, and it includes a circular coil portion 74 having a reduced inwardly extending end portion 75 and an elongated arm portion 76.

The pivot assembly 38 is adapted to be assembled in the manner illustrated by first assembling the torsion spring 46 with the pivot arm 44 by inserting the reduced terminal end portion of the coil portion 74 through the aperture 72 and positioning the coil portion 74 around the spacers 64. The arm portion 76 of the torsion spring 46 is then passed through the pivot opening 42, and the pivot shafts 62 are passed downwardly through the side portions 50 of the opening 42 into the notches 56 in the mounting walls 52. The pivot arm 44 is then pivoted downwardly and rearwardly to the position illustrated in FIG. 8 to allow the arcuate retaining wall segment 70 to pass inwardly beyond the retaining ridges 58 on the inner sides of the mounting walls 52. In this regard, the arcuate retaining wall segment 70 is specifically oriented on the pivot member 44 so that when the pivot arm 60 is pivoted downwardly to the rearmost position thereof illustrated in FIG. 8, the wall segment 70 is no longer aligned with the ridges 58 so that the wall segment 70 can be passed inwardly beyond the ridges 58. Accordingly, by inserting the shafts 62 so that they are fully received in the notches 56 and then allowing the pivot arm portion 60 to return to the upward position illustrated in FIGS. 3 through 5, the retaining wall segment 70 is positioned inwardly beyond the ridges 58 so that it rides on the ridges 58 as the pivot member 44 is pivoted. Further, the ridges 58 effectively retain the shaft 60 in position in the notches 56 as the pivot member 44 is pivoted throughout substantially the entire pivotal movement thereof.

In addition, it is pointed out that while the pivot assembly 38 as herein embodied is constructed so that the retaining wall segments 70 can pass by the ridges 58 for assembling the pivot member 44 with the housing 40 and also for disassembling the pivot member 44 therefrom, other embodiments are contemplated wherein the pivot member 44 is snap receivable in permanent interlocking engagement with other types of retaining members as the shafts 62 are assembled in the notches 56 to more permanently pivotably mount the pivot member 44 on the housing 38.

It is seen, therefore, that the instant invention provides an effective mechanism for pivotably mounting a pivot member on a housing. The pivot member 44 is adapted to be simply and easily assembled by passing the shafts 62 downwardly through the side portions 50 until the shafts 62 are fully received in the notches 56. By then pivoting the pivot member, the retaining wall segment 70 is received in interlocking engagement with the retaining ridges 58 to effectively retain the pivot member 44 in the notches 56 in the mounting walls 52. Hence, it is seen that the instant invention provides a pivot assembly which has significant advantages over the heretofore available pivot assemblies and which therefore represents a significant advancement in the art which has substantial commercial merit.

Figure 9:
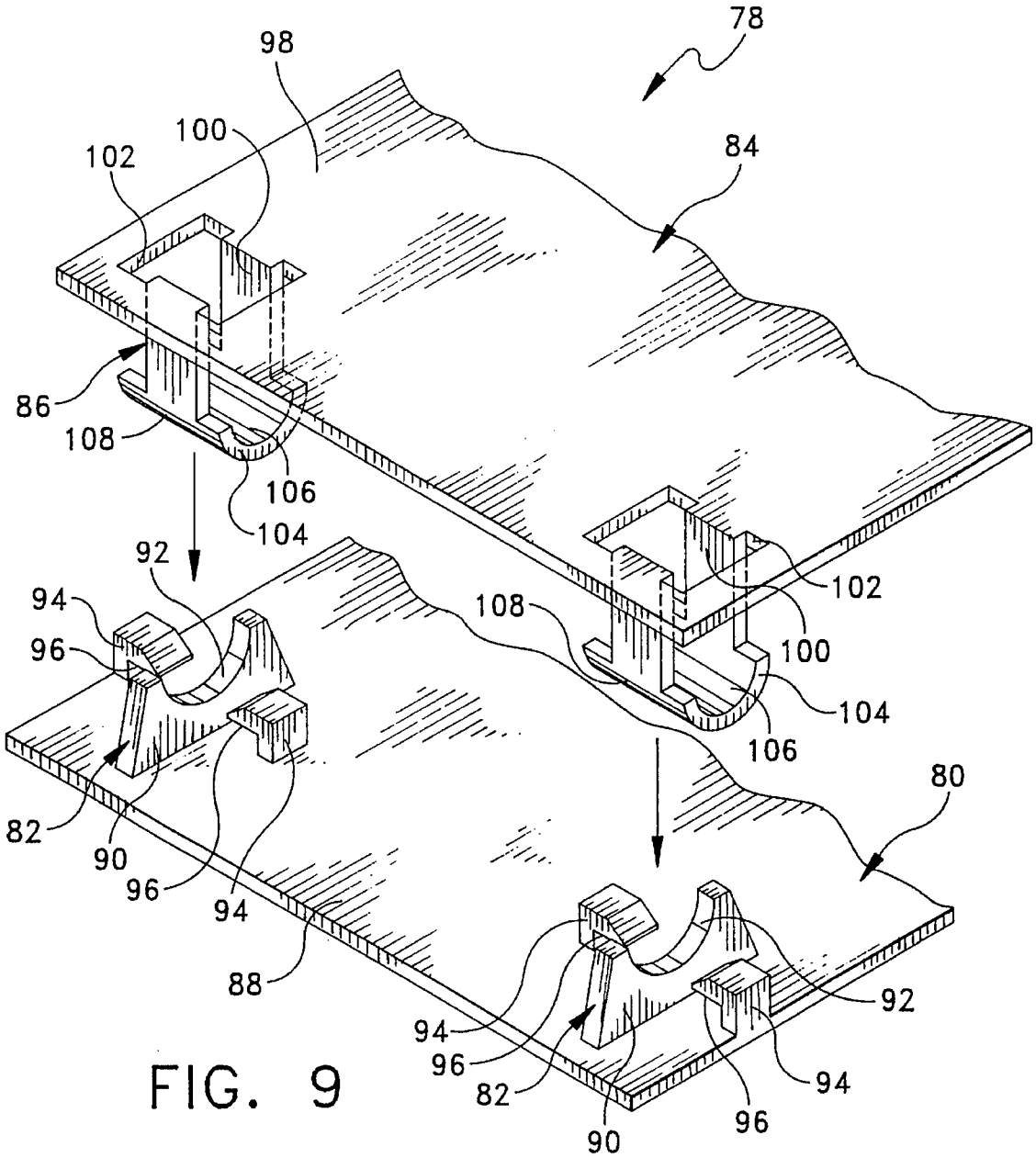
FIG. 9 is an exploded perspective view of a second embodiment of the pivot assembly of the instant invention.

Referring to FIG. 9, a second embodiment of the pivot assembly of the instant invention is illustrated and generally indicated at 78. The assembly 78 comprises a base member generally indicated at 80, including a pair of mounting portions generally indicated at 82 and a pivot member generally indicated at 84, including a pair of pivot member mounting portions generally indicated at 86. The mounting portions 82 and 86 are adapted for pivotally mounting the pivot member 84 on the base member 80 so that the pivot member 84 is freely pivotable without interference from the mounting portions 82 and 86 as will hereinafter be more fully set forth.

The base member 80 as herein embodied comprises a substantially flat plate portion 88 which is preferably made from a suitable plastic material, and the mounting portions 82, which are preferably also made from the same suitable plastic material, extend integrally from the plate portion 88. Each of the mounting portions 82 includes a center mounting seat portion 90 having an upwardly facing arcuate concave pivot face 92 thereon and a pair of retaining portions 94 which are disposed on opposite sides of the mounting seat portion 90 thereof. The retaining portions 94 are of generally L-shaped configuration and they include downwardly facing retaining faces 96. The retaining faces 96 are of arcuate convex configuration, and they are concentrically oriented with respect to the pivot face 92 thereof, although they are preferably radially spaced relative thereto.

The pivot member 84 includes a substantially planar pivot plate portion 98 which is preferably integrally made from a suitable plastic material, and the mounting portions 86 are preferably integrally formed therewith from the same plastic material. The mounting portions 86 each include a pair of support arms 100 which extend downwardly from the pivot plate 98 adjacent an aperture 102 and an arcuate pivot wall 104 having spaced concave and convex surfaces 106 and 108, respectively. The surfaces 106 and 108 are formed in concentric but radially spaced orientation. Further, each of the surfaces 106 forms a retaining face which preferably has the same radius of curvature as the retaining face 96 thereof, and each of the surfaces 108 forms a pivot face which has the same radius of curvature as the pivot face 92 thereof. The pivot portions 86 are received in mating engagement with the respective pivot portions 82 thereof so that the pivot faces 92 and 108 are received in mating engagement and so that the retaining faces 96 and 106 are also received in mating engagement. Accordingly, the retaining faces 106 and 96 cooperate to retain the pivot faces 108 and 92 in mating engagement as the pivot member 84 is pivoted relative the base member 80.

Accordingly, it is seen that the pivot assembly 78 also provides an effective mechanism for pivotably mounting a pivot member on a housing. Specifically, it is seen that the assembly 78 provides an effective readily assembled mechanism for pivotably mounting the pivot member 84 so that it is freely pivotable without interference from the mounting portions 82 and 86.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pivot assembly comprising:

a. a housing including an outer wall having a pivot opening therein;

b. a pair of spaced substantially parallel mounting walls extending inwardly in said housing adjacent spaced opposite side extremities of said pivot opening, said mounting walls having substantially parallel notches therein which open outwardly through said pivot opening;

c. a pivot arm including an elongated main arm portion and a substantially transverse pivot shaft portion on said main arm portion, said pivot shaft portion being received in said notches for pivotably mounting said pivot arm for movement between first and second oppositely pivoted positions;

d. first retaining means on at least one of said mounting walls spaced inwardly in said housing on the opposite side of the notches in the mounting walls thereof from said pivot opening; and e. second retaining means on said pivot member spaced from said shaft portion and engaging said first retaining means to prevent removal of said shaft portion from said notches through said pivot opening when said pivot arm is in an intermediate pivoted position between said first and second pivoted positions.

2. In the pivot assembly of claim 1, said second retaining means comprising an inner guide portion of said pivot arm which is disposed inwardly in said housing relative to said first retaining means and engages said first retaining means when said pivot arm is in said intermediate pivoted position for retaining said pivot shaft in said notches.

3. In the pivot assembly of claim 2, said first retaining means comprising a retaining ridge on at least one of said mounting walls, said inner guide portion riding on said retaining ridge during a portion of the pivotal movement of said pivot arm between the first and second positions thereof.

4. In the pivot assembly of claim 3, said retaining ridge extending inwardly from said at least one of said mounting walls toward the other of said mounting walls.

5. In the pivot assembly of claim 3, said retaining means comprising a pair of said retaining ridges extending inwardly and together from opposite mounting walls terminating in spaced relation.

6. In the pivot assembly of claim 3, said guide portion comprising an arcuate wall segment which is coaxially oriented relative to said pivot shaft.

7. In the pivot assembly of claim 1, said first retaining means comprising a retaining ridge on at least one of said mounting walls extending in a direction toward the other of said mounting walls.

8. In the pivot assembly of claim 1, said first retaining means extending inwardly from said at least one of said mounting walls toward the other of said mounting walls.

9. In the pivot assembly of claim 1, said first and second oppositely pivoted positions defining opposite extremities of the pivotal movement of said pivot arm.

10. In the pivot assembly of claim 9, said first and second retaining means being disengaged and therefore permitting removal of said shaft portion from said notches through said pivot opening when said pivot arm is in one of said first or second positions thereof.

11. In the pivot assembly of claim 10, said first and second retaining means preventing removal of said pivot shaft from said notches through said pivot opening in substantially all pivoted positions of said pivot member other than said one of said first and second positions.

12. A pivot assembly comprising:

a. a housing including an outer wall having a pivot opening therein;

b. a pair of spaced substantially parallel mounting walls extending inwardly in said housing adjacent spaced opposite side extremities of said pivot opening, said mounting walls having substantially parallel notches therein which open outwardly through said pivot opening, said notches defining a pivot seat in said housing;

c. a pivot arm including an elongated main arm portion and a substantially transverse pivot shaft portion on said main arm portion, said pivot shaft portion having a pivot axis and being received in said pivot seat for pivotably mounting said pivot arm for movement between first and second extreme oppositely pivoted positions;

d. first retaining means mounted in a fixed position in interim of said housing and including a first retaining element which is spaced radially outwardly from said pivot axis; and e. second retaining means on said pivot member spaced from said pivot axis and engaging said first retaining element to prevent removal of said shaft portion from said notches through said pivot opening when said pivot arm is in an intermediate pivoted position between said first and second pivoted positions.

13. In the pivot assembly of claim 12, one of said first and second retaining means comprising an arcuate guide wall segment, said guide wall segment extending over an arc segment which is concentrically oriented relative to said pivot axis.

14. In the pivot assembly of claim 12, said first and second retaining means comprising first and second arcuate guide wall segments, said guide wall segments extending over arc segments which are concentrically oriented relative to said pivot axis, said first retaining means being interposed between said second retaining means and said pivot opening when said pivot arm is in said intermediate pivoted position to thereby prevent removal of said shaft portion from said notches through said pivot opening.

15. In the pivot assembly of claim 12, said first retaining means including a convex retaining face, said second retaining means including a concave retaining face which is received in mating engagement with said convex retaining face for preventing the removal of said shaft portion from said notches.

16. A pivot assembly comprising a base member, including a mounting portion having oppositely facing, arcuate, concentric, radially spaced concave pivot and convex retaining faces thereon, having first and second radii of curvature, respectively, a pivot member including a mounting portion having oppositely facing, arcuate, concentric, convex pivot and concave retaining faces thereon also having said first and second radii of curvature, respectively, the pivot faces of said base member and pivot member mounting portions being received in mating engagement for pivotally mounting said pivot member on said base member and the retaining faces of said base member and pivot member mounting portions being received in mating engagement and cooperating for maintaining the pivot faces of said base member and said pivot member in mating engagement.

17. In the pivot assembly of claim 16, the pivot faces and the retaining faces of said pivot member and base member mounting portions all being disposed within a common 180 degree sector about a common pivot axis.

18. In the pivot assembly of claim 17, said base member comprising a housing having a pivot arm opening therein, said base member mounting portion extending inwardly in said housing adjacent said pivot arm opening, said pivot member mounting portion being disposed in said housing, said pivot member further including a pivot arm extending from said mounting portion thereof outwardly through said pivot arm opening.

19. In the pivot assembly of claim 18, said pivot member including a transversely extending cylindrical pivot shaft, said pivot shaft defining said pivot member convex pivot face and being concentrically oriented along said pivot axis.

* * * * *